US005258767A

United States Patent [19]

Nomoto et al.

[11] Patent Number: 5,258,767

[45] Date of Patent: Nov. 2, 1993

[54] ANTENNA SYSTEM FOR SHAPED BEAM

[75] Inventors: Shinichi Nomoto; Fumio Watanabe; Yoshihiko Mizuguchi, all of Tokyo, Japan

[73] Assignee: Kokusai Denshin Denwa Co., Ltd., Tokyo, Japan

[21] Appl. No.: 852,507

[22] Filed: Mar. 17, 1992

Related U.S. Application Data

[63] Continuation of Ser. No. 663,049, Feb. 27, 1991, abandoned, which is a continuation of Ser. No. 493,069, Mar. 13, 1990, abandoned.

[30] Foreign Application Priority Data

Mar. 14, 1989 [JP] Japan ..... 1-59762
Mar. 14, 1989 [JP] Japan ..... 1-59763

[51] Int. Cl.[5] ..... H01Q 15/160; H01Q 19/170

[52] U.S. Cl. ..... 343/781 R; 343/776; 343/912; 343/835

[58] Field of Search ..... 343/775, 779, 781 R, 343/912, 914, 837, 835

[56] References Cited

U.S. PATENT DOCUMENTS

| | | | |
|---|---|---|---|
| 3,995,275 | 11/1976 | Betsudan et al. | 343/914 |
| 4,605,935 | 8/1986 | Kusano | 343/914 |
| 4,811,029 | 3/1989 | Nomoto et al. | 343/781 P |

FOREIGN PATENT DOCUMENTS

| | | | |
|---|---|---|---|
| 0219321 | 4/1987 | European Pat. Off. . | |
| 0275062 | 7/1988 | European Pat. Off. . | |
| 0023450 | 2/1979 | Japan | 343/781 P |
| 0099804 | 7/1980 | Japan | 343/779 |
| 0002704 | 1/1981 | Japan | 343/837 |
| 0229902 | 12/1984 | Japan | 343/781 R |
| 0003210 | 1/1985 | Japan | 343/914 |
| 0814976 | 6/1959 | United Kingdom | 343/914 |
| 2133011 | 7/1983 | United Kingdom . | |
| 2135132 | 8/1984 | United Kingdom | 343/781 R |

OTHER PUBLICATIONS

Rusch, W. T., The Current State of the Reflector Antenna Art, IEEE Trans. on Ant. & Prop., AP 32, No. 4, Apr. 1984 pp. 313–326.

"Calculation of Doubly Curved Reflectors for Shaped Beams", Dunbar, Proceedings of the I.R.E.—Waves and Electrons Section, Oct., 1948, pp. 1289–1296.

"Advanced Satcom Communication Antennas", Parekh et al, 1985 IEEE, pp. 1293–1298.

"Intelsat VI Antenna System Overview", Lane et al., AIAA 10th Communication Satellite Systems Conference, Mar., 1984, pp. 1–12.

*Primary Examiner*—William Mintel
*Assistant Examiner*—Peter Toby Brown
*Attorney, Agent, or Firm*—Armstrong, Westerman, Hattori, McLeland & Naughton

[57] ABSTRACT

A shaped beam antenna system which provides a desired shape of beam, comprises a reflector and at least one primary radiator located essentially at focus of said reflector. Reflection surface of the reflector is a dense set of parabolas in which vertexes of said parabola shift on a predetermined locus which is preferably a three dimensional space curve, but not a plane curve. A second feature of the shaped beam antenna system is the primary radiator which is composed of a plurality of primary radiators positioned closely to each other.

6 Claims, 9 Drawing Sheets

Fig. 1A
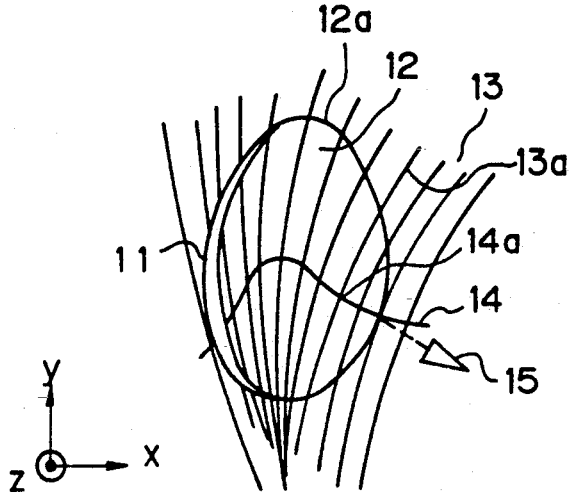
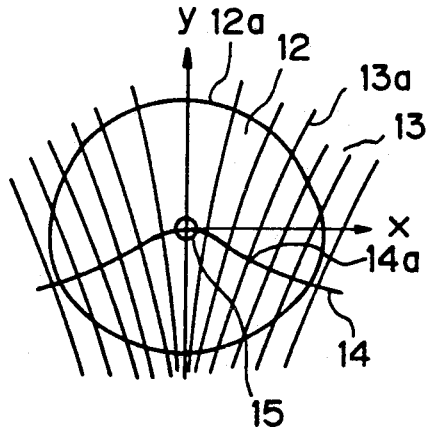
Fig. 1B

Fig. 2A(a)
PRIOR ART
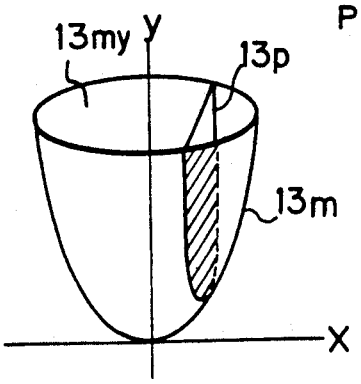
Fig. 2A(b)
PRIOR ART
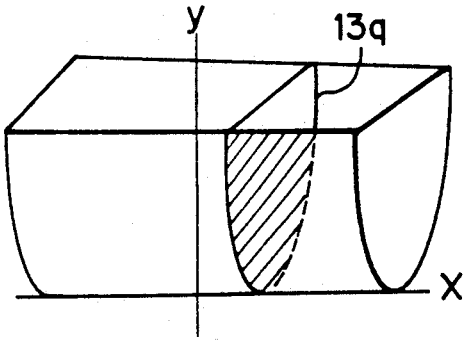
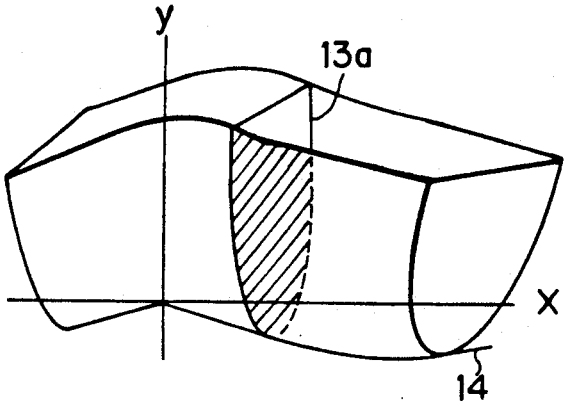
Fig. 2A(c)
Fig. 2B
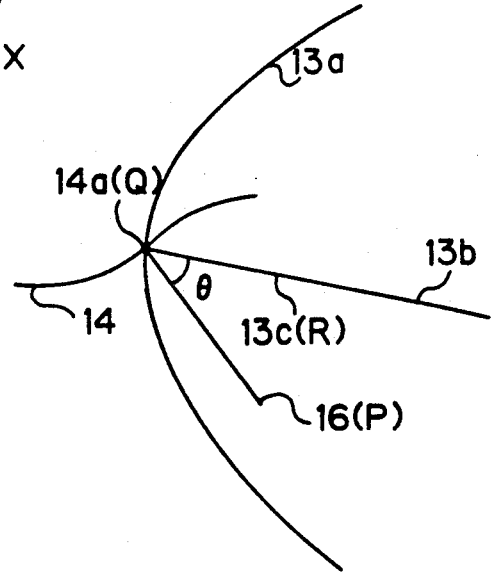

Fig. 3
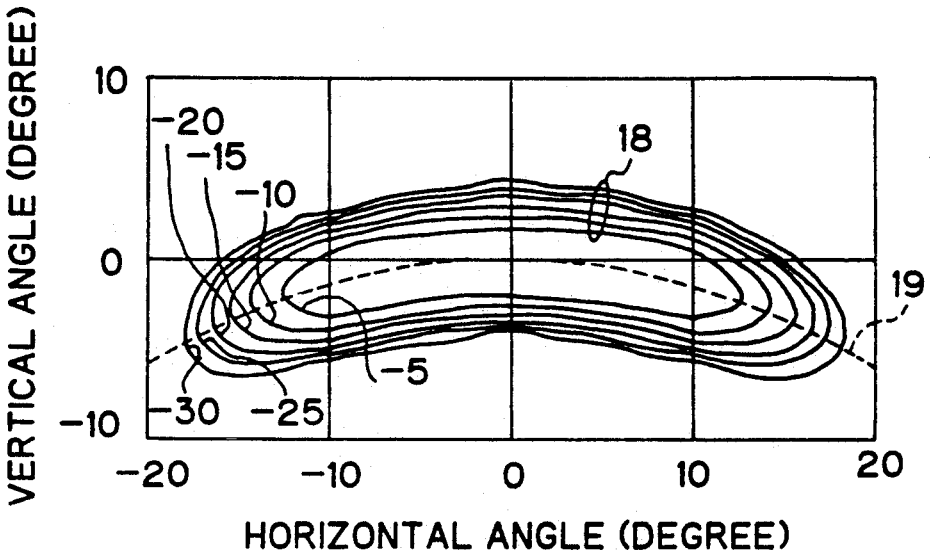
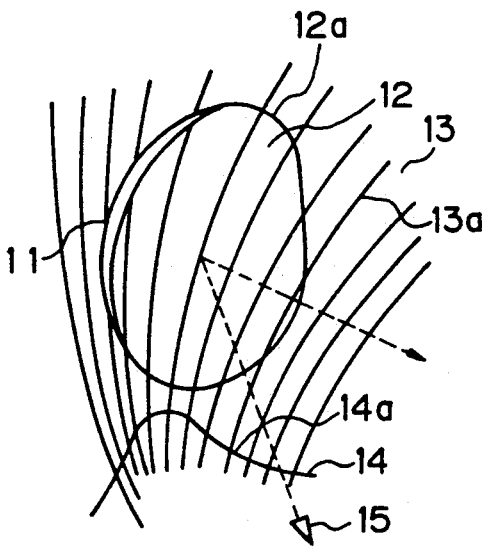
Fig. 4A
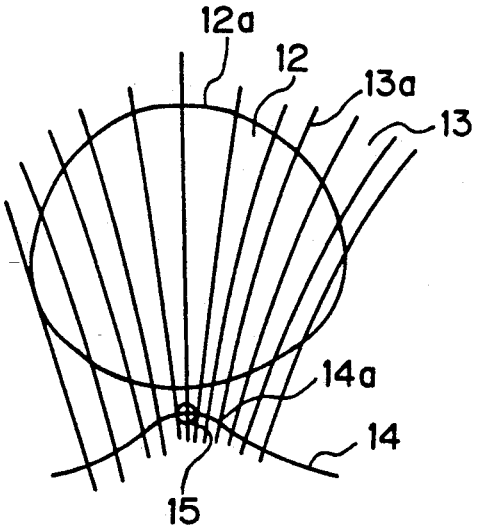
Fig. 4B

Fig. 5A
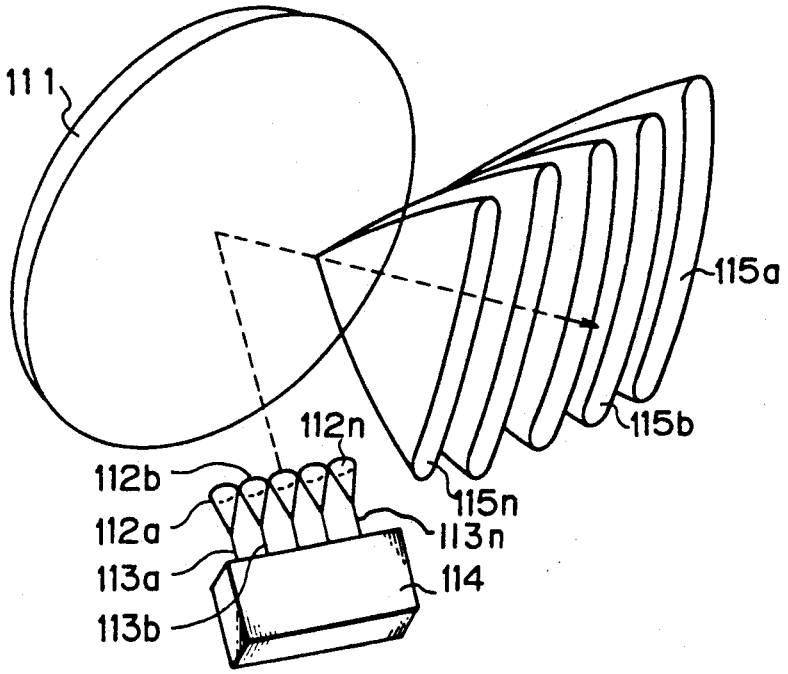
Fig. 5B
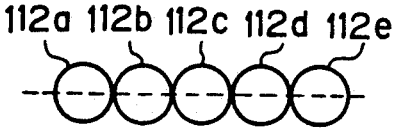
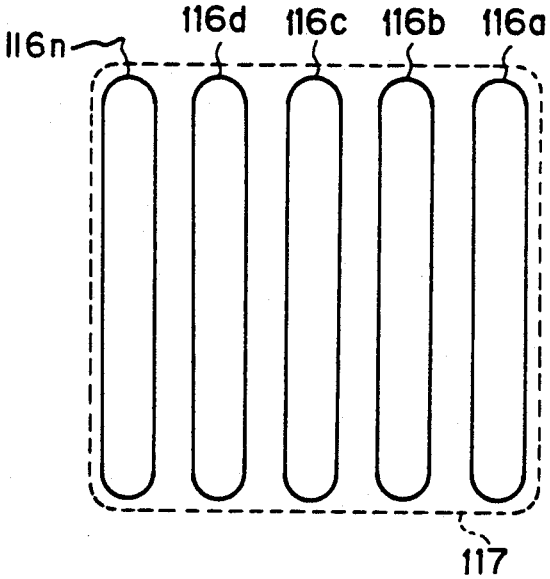
Fig. 5C

Fig. 6A
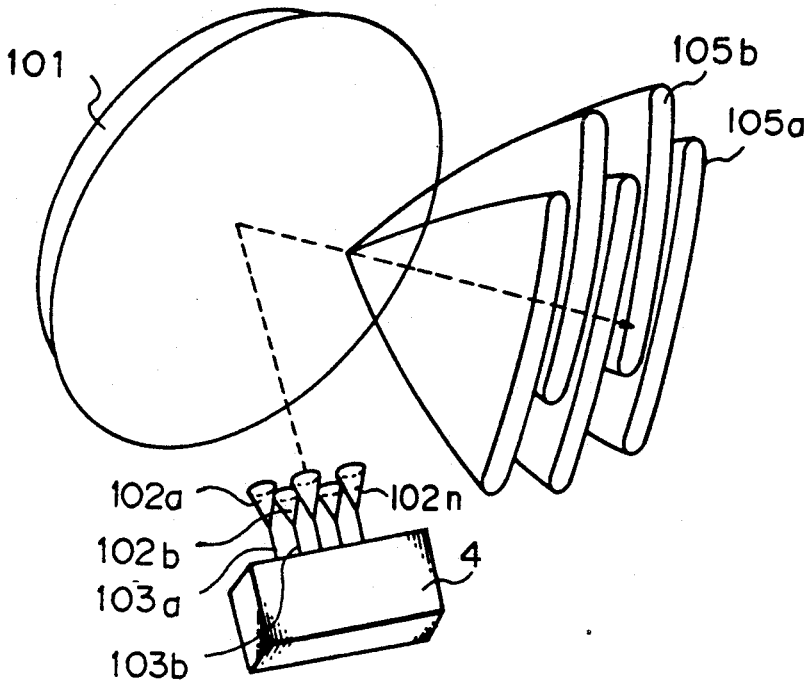
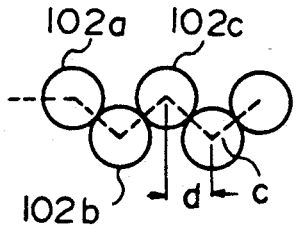
Fig. 6B
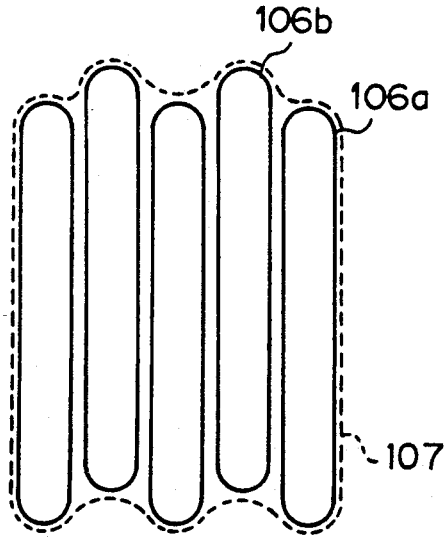
Fig. 6C

Fig. 7A
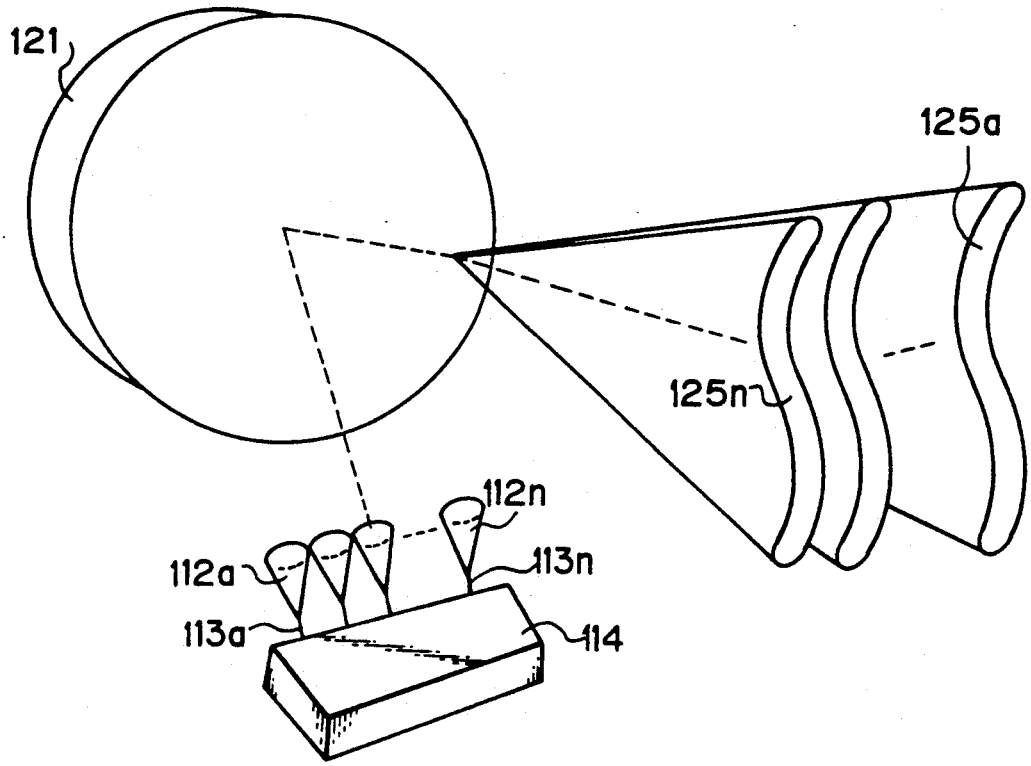
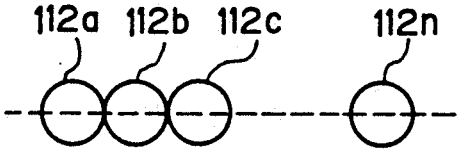
Fig. 7B
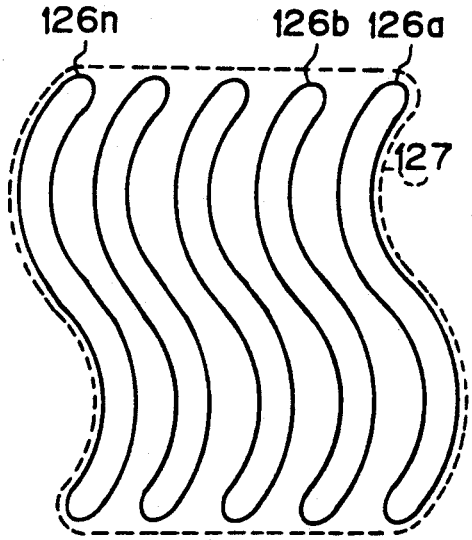
Fig. 7C

Fig. 11A
PRIOR ART
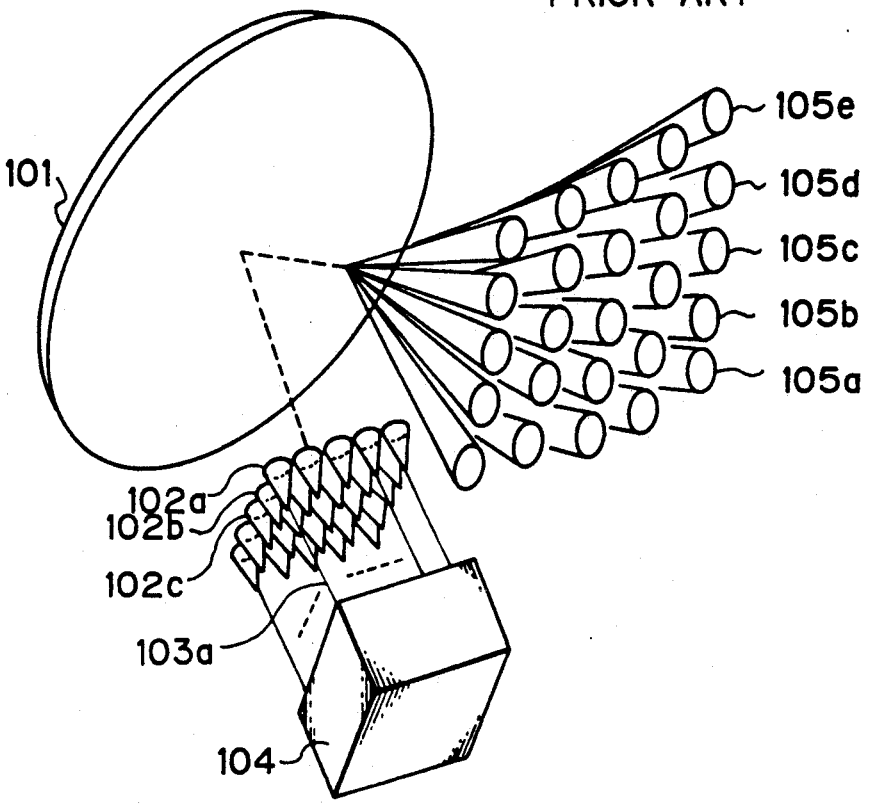
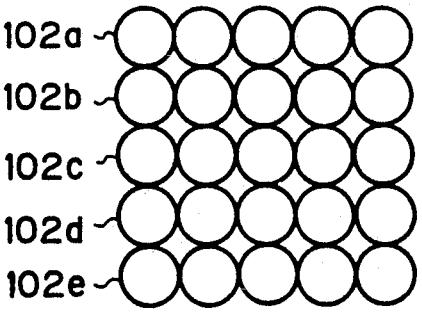
Fig. 11B
PRIOR ART
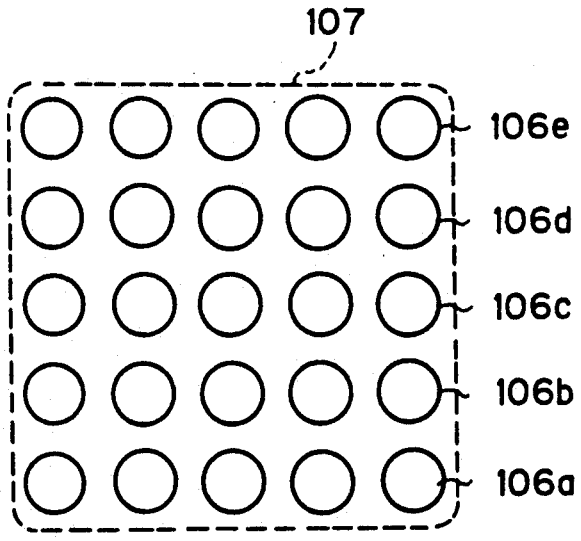
Fig. 11C
PRIOR ART

ANTENNA SYSTEM FOR SHAPED BEAM

This application is a continuation of application Ser. No. 663,049 filed Feb. 27, 1991, now abandoned, which in turn is a continuation of application Ser. No. 493,069 filed Mar. 13, 1990, now abandoned.

BACKGROUND OF THE INVENTION

The present invention relates to a shaped beam antenna system, in particular, relates to such an antenna system which illuminates the desired shape of area.

A shaped beam is obtained by a paraboloidal reflector with a primary radiator. When a primary radiator is positioned so that the phase center of the same coincides with the focus of the paraboloidal reflector, the wavefront of the reflected wave is along a plane, thus a sharp beam is radiated in the principal axis direction of the parabola. On the contrary, a paraboloidal reflector focuses a plane wave incoming from the principal axis upon the focus. In fact, the radiation pattern of an antenna is the same whether it is used as a transmitting antenna or a receiving antenna according to the reciprocity theorem of an antenna pattern. So, the following description is directed to a transmit antenna, but it should be appreciated of course that a receive antenna is possible in a similar manner.

Conventionally, a reflector has been used so that a wave is radiated sharply in a desired direction, and a minimal wave is radiated in an undesired direction. A pencil beam, or a sharp beam, has been obtained by using a paraboloidal reflector.

On the other hand, when a shaped beam which illuminates a desired shaped service area is requested, a fan-shaped bream is necessary.

One prior art method for providing a fan-shaped beam is the use of a plurality of pencil beams, each of which independently illuminates a different related area.

FIG. 11 shows the conventionally shaped beam antenna system, wherein FIG. 11A is a perspective view; FIG. 11B is a cross section of the array of the primary radiators; and FIG. 11C is the equi-level contour pattern wherein the shape of a beam footprint is shown on a specified surface formed by the intersection of the surface. In FIG. 11A, the reference numeral 101 is a reflector, 102*a* through 102*e* are primary radiators, 103*a* through 103*e* are feeders for feeding the primary radiators, 104 is a beam forming network, 105 through 105*e* are element beams, 106*a* through 106*e* are equi-level contour pattern of element beams, and 107 is the equi-level contour pattern of the combined shaped beam. The reflector 101 is a paraboloidal reflector, and a $5\times5(=25)$ number of primary radiators are used in the embodiment. Each of the element beams 105*a* through 105*e* is a pencil beam, and provides the small circle of equi-level pattern as shown by the reference numerals 106*a* through 106*e*. When the primary radiators 105*a* through 105*e* are simultaneously excited through the beam forming network 104, the whole shaped beam 107 which is the sum of the element beams 106*a* through 106*e* is obtained. When the beam forming network 104 adjusts the amplitude and the phase of the exciting signal applied to each primary radiator, a desired shape beam is obtained. The antenna system of FIG. 11 has been used as a satellite antenna for illuminating a desired area on earth.

However, the conventional antenna system of FIG. 11 has a disadvantage in that so many primary radiators (25 radiators in FIG. 11) must be used, and therefore, the same number of feed lines must be used, and the structure of the beam forming network 104 becomes complicated. Further, the minimum spacing between the adjacent element beams is restricted by the physical size of the primary radiators. When the spacing between two adjacent element beams is large, the electric power flux density on earth is not uniform, but the flux density is weak at the gap area between two adjacent element beams. Therefore, it is difficult to provide a shaped beam uniform flux density.

Another prior method for providing a shaped beam is the use of a reflector and signal primary radiator wherein the reflector is a cylindrical paraboloid; i.e., a dense set of parabolas shifted parallel along a predetermined straight line. The just-described prior art method is in accordance with FIGS. 8 through 10.

FIG. 8 shows the reflector of the second prior art method, wherein reference numeral 1 is a reflector; 2 is a reflection plane which is a part of the reflector 1; 2*a* is an edge of the reflection surface; 3 is a cylindrical paraboloid which composes said reflection surface 2; 4 is a straight line on which vertexes 4*a* of the parabolas 3*a* locuses; 4*a* is a vertex of a parabola 3*a*. The curved surface 3 is a dense set of parabolas 3*a* which shift in parallel so that the locus of the vertexes of the parabolas 3*a* is a straight line 4. In other words, the curved surface 3 is a cylindrical paraboloid in this case. The reflector 1 can provide a fan-beam on an elongated service area. The more advanced technique invented by Dunbar (Calculation of Doubly Curved Reflectors for Shaped Beams Proceedings of the IRE Wave and Electrons Section, pages 1289–1296; October, 1948) for beam shaping consists of forming the reflector 1 from the plane-curve locus 4 which lies on the plane of symmetry. After finding the proper plane-curve locus 4 by Dunbar's method, the reflector 1 producing a flat fan-beam with an arbitrary power pattern over the straight, elongated beam footprint can be obtained.

FIG. 9 shows the shape of the fan-beam of the reflector 1 in the form of the equi-level contour pattern, wherein the horizontal axis shows the horizontal angle and the vertical axis shows the vertical angle. The numeral 8 shows the equi-level contour pattern and the numeral in the figure shows the level in dB.

However, the second prior art method described in accordance with FIGS. 8 through 9 has a disadvantage in that the elongated contour is only in a straight linear shape, and wherein another shape of a fan-beam with a footprint which is a curvilinear contour is impossible. This is explained in accordance with FIG. 10.

In FIG. 10, the reference numeral A(9*a*) is the position of a reflector; B and C are ends of a target to be illuminated; D is a foot of a perpendicular on the surface which includes the arc BC(9*b*) from the point A; 7 is a fan-beam having the shape relating to the arc BC, and 9*c* is a linear line between the points B and C. When a reflector 1 is positioned at the point A(9*a*), and the object on the arc BC(9*b*) on the plane with the spacing (h) from the point A is illuminated, the fan-beam must be in the curved shape 7 which is curved similar to the arc (9*b*). However, the second prior art method which has a reflector 1 with the locus 4 of the vertexes of the parabolas 3*a* on the plane of symmetry can only provide a linear-shaped beam for the linear line 9*c*, but not a curved shaped beam for the arc BC. Therefore, the second prior art method cannot provide a curved fan-beam when h is not zero, although it can provide the same when h is zero, even if the locus 4 of the vertexes of the parabolas 3*a* is not a straight line, but a plane curve on the plane of symmetry.

SUMMARY OF THE INVENTION

It is an object, therefore, of the present invention to overcome the disadvantages and limitations of the conventional antenna system by providing a new and improved antenna system.

It is also an object of the present invention to provide an antenna system which can provide a beam of a desired shape.

It is also an object of the present invention to provide a beam of a desired shape by using a small number of primary radiators.

The above and other objects are attained by an antenna system having at least a reflector and at least one primary radiator positioned essentially at focus of the reflector. The antenna system of this invention includes a reflector having a reflection surface which is a part of a dense set of parabolas which shifts vertexes of the parabolas on a predetermined locus, wherein the parabolas shift on the locus keeping the principal axis of each parabola in the direction of a target on the service area to be illuminated by the antenna system, and the locus is a space curve, which does not lie on any plane other than a line or a plane curve.

Additionally, the second structural feature of this invention is the primary radiator which is composed of a plurality of primary radiators positioned closely to each other.

BRIEF DESCRIPTION OF THE DRAWINGS

The foregoing and other objects, features, and attendant advantages of the present invention will be appreciated as the same becomes better understood by means of the following description and accompanying drawings wherein:

FIGS. 1A and 1B show an embodiment of a reflector according to the present invention;

FIGS. 2A(*a*), 2A(*b*), 2A(*c*) and 2B show the explanatory drawings for explaining a reflector according to the present invention;

FIG. 5 shows an equi-level contour pattern of a reflector according to the present invention;

FIGS. 4A and 4B show another reflector according to the present invention;

FIGS. 5A, 5B and 5C show still another embodiment of the antenna system according to the present invention;

FIGS. 6A, 6B and 6C show still another embodiment of the antenna system according to the present invention;

FIGS. 7A, 7B and 7C show still another embodiment of the antenna system according to the present invention;

FIGS. 11A, 11B and 11C show a conventional antenna system.

DESCRIPTION OF THE PREFERRED EMBODIMENTS

Embodiment 1

Figure 8:
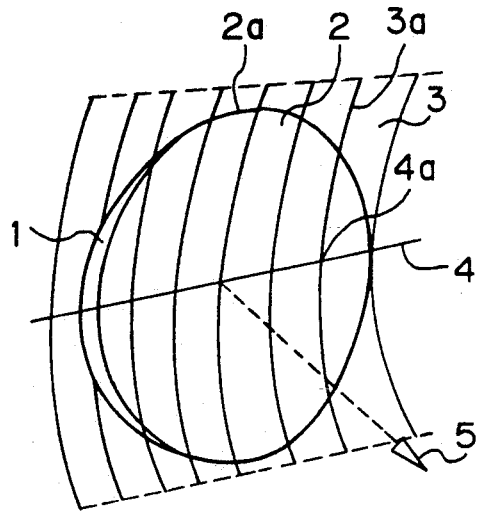
Fig. 8 PRIOR ART
FIG. 8 shows a conventional reflector.
Figure 9:
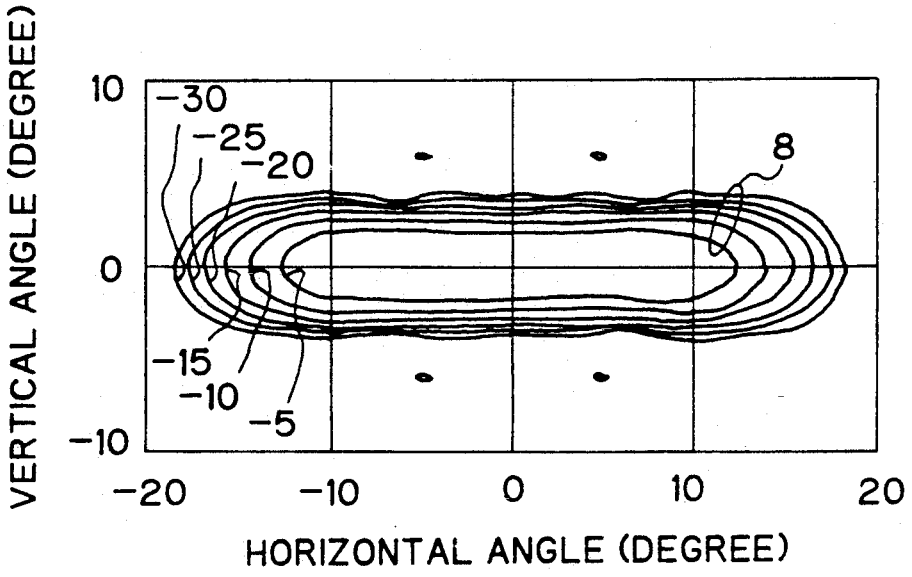
Fig. 9 PRIOR ART
FIG. 9 shows a conventional equi-level pattern.
Figure 10:
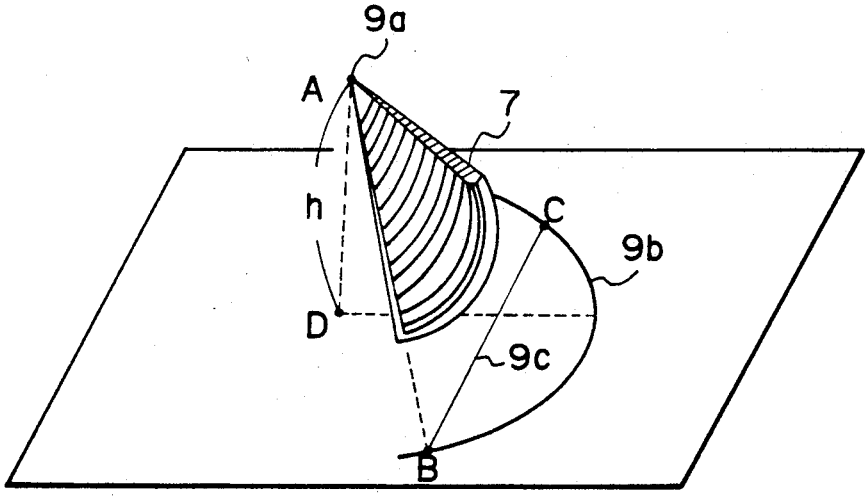
FIG. 10 shows a required fan-beam.

FIG. 1 shows the first embodiment of the present invention, in which FIG. 1A is a perspective view of a reflector, and FIG. 1B is a front view of a reflector.

The reflection surface 12 of the reflector 11 is a part of the curved surface 13 which is the dense set of the parabola 13*a*, and the reflection surface 12 is restricted by the edge 12*a*. The important feature of the present invention is that the locus 14 of the vertexes of the parabola 13*a* is a space curve (three dimensional curve), but not a plane curve. The electromagnetic wave radiated by the primary radiator 15 is reflected by the reflector 11, and the reflected wave produces an elongated curved fan-beam since the locus 14 of the vertexes 14*a* of the paraboloid 13*a* is a space curve which has double curvature.

The locus 14 is designed as follows.

In a first method, the locus 14 is obtained by solving the ordinary differential equation which uses the geometrical optics approximation which has been used for the design and analysis of a reflector. In other words, the locus 14 is obtained by using Snell's law of reflection for reflection of a ray composing a beam, and the power conservation law for an input beam energy and an output beam power, and is obtained by the following equation:

$$P_1 dw = P_2 d\phi \tag{1}$$

where $P_1$ is a radiation power pattern of a primary radiator 15; $P_2$ is a secondary power pattern of a reflector 11; dw is a cubic angle element subtended by a part of the parabola 13*a* within the edge 12*a* for the primary radiator 15; and $d\phi$ is the plane angle element relating to the angle of the output beam reflected by the parabola 13*a*.

The equation (1) is an ordinary differential equation for the locus 14, and therefore, the accurate numerical solution is obtained by using the Runge-Kutla method.

Alternatively, the locus 14 is obtained by using the computer-aided optimization method through numerical simulation for providing the optimum solution. In that case, the initial coordinates of the locus 14 are determined to be analogous to the central curve (19 in FIG. 3) of the footprint of the fan-beam, and the shape of the fan-beam is calculated for the provisional locus 14. Next, the coordinates of the locus 14 are slightly modified to see if the shape of the fan-beam changes preferably by the modification. By repeating that process, the final coordinates of the locus 14 which provide the desired fan-beam is obtained.

The present invention is again described in accordance with FIG. 2 in detail with respect to the relationship of the focus of the parabola 13*a* and the vertex Q(14*a*).

FIG. 2A(*a*) shows that the paraboloid 13*my* on the XY coordinates provides a conventional paraboloidal reflector by rotating a parabola 13*m* around the Y-axis. The same paraboloidal reflector is obtained as the dense set of the parabolas 13*p* which are perpendicular to the XY plane, and has the parabolic locus which is the same as the parabola 13*m* on which the vertexes of the parabolas 13*p* shift. The direction of the principal axis of the parabolas is constantly directed to a target on the service area to be illuminated during the shift. In other words, a paraboloidal reflector is a dense set of parabolas 13*p* having vertexes with a parabolic locus 13*m*. It is noted that a principal axis of each parabola is defined as a line intersecting the vertex of the parabola and a focus of the parabola (see, FIG. 2B).

On the other hand, a dense set of parabolas 13*q* which has a locus (on which the vertexes of the parabolas shift) equal to X-axis as shown in FIG. 2A(*b*) is a conventional reflector 3 as shown in FIG. 8.

The present invention has the locus 14 which is not a plane curve, but a three dimensional space curve with a double curvature, as shown in FIG. 2A(*c*). The surface of the present reflector is a part of densely joined plurality of parabolas 13*a* having principal axes which do not necessarily lie on the XY plane in FIG. 2A(*c*). The parabolas 13*a* shift along the locus 14 so that the vertexes of the parabolas 13*a* shift on the locus 14 keeping the principal axis of the parabolas 13*a* in the direction of a target on the service area to be illuminated by the antenna system.

It should be noted that the conventional locuses form a plane curve, while the locus 14 of the present invention does not form a plane curve, but a three dimensional space curve.

FIG. 2B shows the cross-section of the present reflector 11 for explaining the focus 13*c* and the vertex Q(14*a*) of the parabolas 13*a*.

The focal length QR satisfies the following equation:

$$QR = PQ \times \frac{1 + \cos\theta}{2} \qquad (2)$$

where $\Theta$ is an angle (<PQR) shown in FIG. 2B and the point P(16) is the fixed point which is common to all the parabolas.

When a primary radiator 15 is positioned so that the phase center of the primary radiator coincides with the point P(16), every reflected ray which is reflected by the parabola 13*a* has uniform phase with respect to the principal axis 13*b* of the parabola 13*a*, and therefore, no reflected ray in undesired directions occurs in terms of geometrical optics. Thus a sharp, thin, and curved fan-beam is obtained.

FIG. 3 shows the shape of the fan-beam in the form of an equi-level contour pattern on a two dimensional angular space. It should be noted that the footprint of the fan-beam is elongated, and the central curve 19 of the footprint of the fan-beam is curved. In FIG. 3, the numeral 18 is an equi-level contour, and 19 is a curved ridgeline of the contour 18

It should be noted that the present invention can provide a fan-beam which has the desired curved ridgeline 19 of the equi-level contours. The shape of the curved ridgeline 19 is almost analogous to the projection of the locus 14. Therefore, when the locus 14 is obtained by using a computer-aided optimization method, the initial profile of the locus 14 is determined so that it is analogous to the desired curved ridgeline 19, and is adjusted so that the desired shape of fan-beam is obtained.

A reflector surface is not restricted to a solid surface, but a wire grid reflector or a mesh reflector is also possible.

Embodiment 2

FIG. 4 shows the second embodiment of the present invention, in which FIG. 4A is a perspective view and FIG. 4B is a front view of a reflector.

The structural feature of the embodiment of FIG. 4 is that the reflector is an offset reflector 11 wherein the locus 14 which is a set of the vertexes 14*a* of the parabolas 13*a* is not included in a reflection surface 12 enclosed by the edge 12*a*. Therefore, it is possible in FIG. 4 to position a primary radiator 15 so that an aperture blocked by the primary radiator 15 is reduced or eliminated. Of course, the embodiment of FIG. 4 can provide the desired shape of the fan-beam.

A reflector surface is not restricted to a solid surface, but a wire grid reflector or a mesh reflector is also possible.

Embodiment 3

FIG. 5 shows another embodiment of the present shaped beam antenna system, in which FIG. 5A is a perspective view; FIG. 5B shows the array of the primary radiators; and FIG. 5C shows the shape of the beams on a two dimensional plane in the form of a the equi-level contour pattern.

In FIG. 5, the reference numeral 111 is a reflector which can provides a fan-shaped beam for each single primary radiator, and 112*a* through 112*n* are primary radiators. In the embodiment, five radiators are shown. The reference numerals 113*a* through 113*n* are feeders; 114 is a beam forming network; 115*a* through 115*n* are element beams; 116*a* through 116*n* are equi-level contours of the element beams; and 117 is the resultant equi-level contour which is the combination of the element equi-level contours 116*a* through 116*n*.

The reflector 111 is not a conventional paraboloidal reflector, but a doubly curved reflector which is a dense set of parabolas having vertexes with the locus which is linear or space curve, as mentioned in accordance with FIG. 2A. Therefore, each of the element beams 115*a* through 115*n* by each primary radiator is an elongated fan-beam. FIG. 5A is an embodiment wherein a plurality of element beams 115*a* through 115*n* are positioned laterally by locating the primary radiators 112*a* through 112*n* linearly as shown in FIG. 5B. The equi-level contour of each fan-beam is shown in FIG. 5C, in which each of the patterns 116*a* through 116*n* is an equi-level contour of each element fan-beam on the two dimensional space. When the beam forming network 114 excites the primary radiators 112*a* through 112*n* which are simultaneously positioned on a straight line, the resultant fan-beam 117 is obtained as the superposition of each of the element fan-beams 116*a* through 116*e*.

As described above, according to the present embodiment, each primary radiator provides an elongated fan-beam because of the specific structure of a reflector, and smaller number of primary radiators as compared with that of FIG. 11 are enough for providing a wide-shaped beam 117 which illuminates a wide rectangular area with a uniform radiation level.

Embodiment 4

FIG. 6 shows still another embodiment of the present invention wherein FIG. 6A is a perspective view; FIG. 6B shows the array of the primary radiators; and FIG. 6C shows the equi-level pattern of the fan-beam.

The structural feature of the embodiment of FIG. 6 as compared with the embodiment of FIG. 5 is that the primary radiators 102*a* through 102*n* are positioned in a zig-zag fashion as shown in FIG. 6B. The central line C connecting the center of the cross section of the primary radiators is not a linear straight line, but is offset for each primary radiator as shown in FIG. 6B, and therefore, the spacing (d) between two adjacent primary radiators is smaller than that of the embodiment shown in FIG. 5. The offset positioning of the primary radiators allows the decrease of the essential spacing between two adjacent fan-beams, and provides the constant field in the resultant fan-beam 107.

Embodiment 5

FIG. 7 shows still another embodiment of the present invention wherein FIG. 7A is a perspective view; FIG. 7B shows the array of the primary radiators 112*a* through 112*n*; and FIG. 7C shows the equi-level contour pattern of the antenna. In FIG. 7A, the reference numeral 121 is a reflector which provides a curved fan-beam as described in accordance with FIG. 3; the reference numerals 125*a* through 125*n* are curved fan-beams; 126*a* through 126*n* are equi-level contour patterns of each fan-beam, and 127 is a resultant equi-level contour pattern.

The structural feature of the embodiment of FIG. 7 as compared to the embodiment shown in FIG. 5 is that each element fan-beam is curved by using the specific reflector described in accordance with FIG. 1 or FIG. 4. It is noted that the shape of each fan-beam in FIG. 7 is curved, and therefore the complicated shape of shaped-beam 127 as shown in FIG. 7C is obtained.

It is noted that the embodiments of FIGS. 5 through 7 are advantageous in that a smaller number of primary radiators as compared with that of FIG. 11 are enough for illuminating a wide area with a uniform flux density since each beam is a fan-beam, but not a spot beam.

From the foregoing, it will now be apparent that a new and improved antenna system has been found. It should be understood of course that the embodiments disclosed are merely illustrative and are not intended to limit the spirit and scope of the invention. Reference should be made to the appended claims, therefore, rather than the specification as indicating the scope of the invention.

What is claimed is:

1. An antenna system, comprising:

at least one reflector; and at least one primary radiator attached to and positioned substantially in focus with said at least one reflector, said at least one reflector having a reflection surface which is, in its entirety, a part of a densely joined plurality of parabolas, each parabola having a vertex, and vertexes of said parabolas being smoothly shifted to define a predetermined locus, said parabolas shifting along said locus to keep a principal axis of each parabola in the direction of the target on a service area to be illuminated by said antenna system, and said locus being a three-dimensional space curve which is defined as a curve having a curvature in three-dimensions, and said principal axis of each parabola defining a line intersecting said vertex of each of said parabolas and a focus of each of said parabolas.

2. An antenna system according to claim 1, wherein said reflection surface excludes said locus defined by said vertexes of said parabolas.

3. An antenna system according to claim 1, wherein said at least one primary radiator is composed of a plurality of primary radiators positioned near each other.

4. An antenna system according to claim 3, wherein said primary radiators are located on a straight line.

5. An antenna system according to claim 3, wherein said primary radiators are positioned so that a center line which connects the center of the cross section of adjoining primary radiators is not a straight line.

6. An antenna system, comprising:

at least one reflector; and a primary radiator system positioned substantially in focus with said at least one reflector, said at least one reflector having a reflection surface which is, in its entirety, a part of a densely joined plurality of parabolas, each parabola having a vertex, and vertexes of said parabolas being smoothly shifted to define a predetermined locus, said parabolas shifting along said locus to keep a principal axis of each parabola in the direction of the target on a service area to be illuminated by said antenna system, said locus being a line other than a parabola and being a three-dimensional space curve which is defined as a curve having a curvature in three-dimensions, said primary radiator system being composed of a plurality of primary radiators positioned near each other, and said principal axis of each parabola defining a line intersecting said vertex of each of said parabolas and a focus of each of said parabolas.

* * * * *